US005971004A

United States Patent [19]

Pringle

[11] Patent Number: 5,971,004

[45] **Date of Patent: *Oct. 26, 1999**

[54] VARIABLE ORIFICE GAS LIFT VALVE ASSEMBLY FOR HIGH FLOW RATES WITH DETACHABLE POWER SOURCE AND METHOD OF USING SAME

[75] Inventor: Ronald E. Pringle, Houston, Tex.

[73] Assignee: Camco International Inc., Houston, Tex.

[ * ] Notice: This patent is subject to a terminal disclaimer.

[21] Appl. No.: 09/037,309

[22] Filed: Mar. 9, 1998

Related U.S. Application Data

[63] Continuation-in-part of application No. 08/912,150, Aug. 15, 1997

[60] Provisional application No. 60/023,965, Aug. 15, 1996.

[51] Int. Cl.[6] ..... F04F 1/20

[52] U.S. Cl. ..... 137/155; 417/109

[58] Field of Search ..... 137/155; 417/109

[56] References Cited

U.S. PATENT DOCUMENTS 3,280,914 10/1966 Sizer et al. .
4,239,082 12/1980 Terral .
5,172,717 12/1992 Boyle et al. .
5,176,164 1/1993 Boyle .
5,469,878 11/1995 Pringle .
5,535,767 7/1996 Schnatzmeyer et al. ..... 137/155 X

FOREIGN PATENT DOCUMENTS 2289296A 11/1995 United Kingdom .

*Primary Examiner*—Gerald A. Michalsky
*Attorney, Agent, or Firm*—Tobor, Goldstein & Healey, LLP

[57] ABSTRACT

The present invention is a surface controlled gas lift valve designed for high flow rates and used in a subterranean well, comprising: a valve and actuating assembly for sealable insertion in a mandrel. The valve has a variable orifice which alternately permits, prohibits, or throttles fluid flow into the valve, and a detachable and/or remote actuator are disclosed. The valve may be actuated using momentary bursts of hydraulic pressure to the actuating assembly. Variable orifice opening settings are achieved by providing successive bursts of hydraulic pressure to the actuating assembly, which cause a cylindrical cam within the actuating assembly to be indexed between multiple support positions. The orifice valve and the actuator while operatively connected, may be separately installed in or retrieved from the mandrel by either wireline or coiled tubing intervention methods.

16 Claims, 8 Drawing Sheets

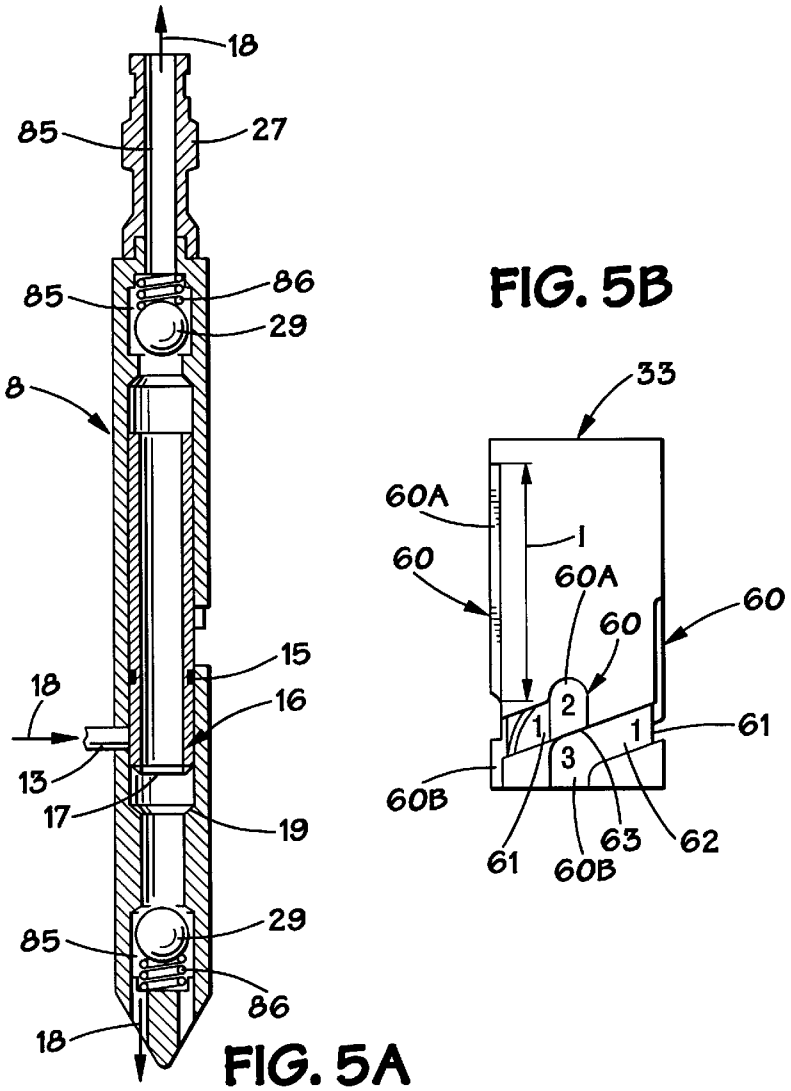
FIG. 5A
FIG. 5B
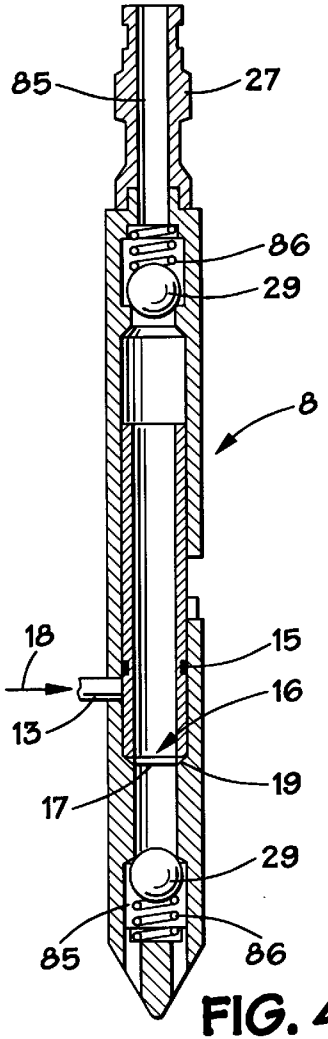
FIG. 4A
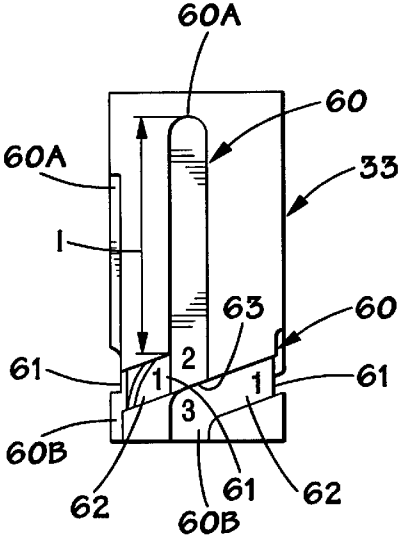
FIG. 4B

VARIABLE ORIFICE GAS LIFT VALVE ASSEMBLY FOR HIGH FLOW RATES WITH DETACHABLE POWER SOURCE AND METHOD OF USING SAME

RELATED APPLICATIONS

This application is a continuation-in-part application of U.S. patent application Ser. No. 08/912,150, filed Aug. 15, 1997,and entitled Variable Orifice Gas Lift Valve For High Flow Rates With Detachable Power Source And Method Of Using, which claims the benefit of U.S. Provisional Application Ser. No. 60/023,965, filed Aug. 15, 1996.

BACKGROUND OF THE INVENTION

1. Field of the Invention

The present invention relates to subsurface well completion equipment and, more particularly, to an apparatus, or valve assembly, for lifting hydrocarbons from subterranean formations with gas at high production rates. Additionally, embodiments of independent and detachable actuators are disclosed.

2. Description of the Related Art

Artificial lift systems, long known by those skilled in the art of oil well production, are used to assist in the extraction of fluids from subterranean geological formations. The most ideal well for a company concerned with the production of oil, is one that flows naturally and without assistance. Often wells drilled in new fields have this advantage. In this ideal case, the pressure of the producing formation is greater than the hydrostatic pressure of the fluid in the wellbore, allowing the well to flow without artificial lift. However, as an oil bearing formation matures, and some significant percentage of the product is recovered, a reduction in the formation pressure occurs. With this reduction in formation pressure, the hydrocarbon issuance therefrom is likewise reduced to a point where the well no longer flows without assistance, despite the presence of significant volumes of valuable product still in place in the oil bearing stratum. In wells where this type of production decrease occurs, or if the formation pressure is low from the outset, artificial lift is commonly employed to enhance the recovery of oil from the formation. This disclosure is primarily concerned with one type of artificial lift called "Gas Lift." It should be noted, however, that a variety of fluid types can be used in accordance with the invention as will readily be perceived by one of ordinary skill in the art. Accordingly, the term "gas" as used herein should not be read as limiting the fluid to gases but, instead, should be read to include any of the variety of process fluids appropriate to artificial lift systems.

Gas lift has long been known to those skilled in the art, as shown in U.S. Pat. No. 2,137,441 filed in November 1938. Other patents of some historic significance are U.S. Pat. Nos. 2,672,827, 2,679,827, 2,679,903, and 2,824,525, all commonly assigned hereto. Other, more recent developments in this field include U.S. Pat. Nos. 4,239,082, 4,360,064 of common assignment, as well as U.S. Pat. Nos. 4,295,796, 4,625,941, and 5,176,164. While these patents all contributed to furthering the art of gas lift valves in wells, recent trends in drilling and completion techniques expose and highlight long felt limitations with this matured technology.

The economic climate in the oil industry of the 1990's demands that oil producing companies produce more oil, which is now exponentially more difficult to exploit, that the oil be produced in less time, and without increasing prices to the consumer. One successful technique that is currently being employed is deviated and horizontal drilling, which more efficiently drains hydrocarbon bearing formations. This increase in production makes it necessary to use much larger production tubing sizes. For example, in years past, 2⅜ inch production tubing was most common. Today, tubing sizes of offshore wells range from 4½ to 7 inches. While much more oil can be produced from tubing this large, conventional gas lift techniques have reached or exceeded their operational limit as a result.

In order for oil to be produced utilizing gas lift, a precise volume and velocity of the gas flowing upward through the tubing must be maintained. Gas injected into the hydrostatic column of fluid decreases the column's total density and pressure gradient, allowing the well to flow. As the tubing size increases, the volume of gas required to maintain the well in a flowing condition increases as the square of the increase in tubing diameter. If the volume of the gas lifting the oil is not maintained, the produced oil falls back down the tubing, and the well suffers a condition commonly known as "loading up." If the volume of gas is too great, the cost of compression and recovery of the lift gas becomes a significant percentage of the production cost. As a result, the size of a gas injection orifice in the gas lift valve is of crucial importance to the stable operation of the well. Prior art gas lift valves employ fixed diameter orifices in a range up to ¾ inch, which may be inadequate for optimal production in large diameter tubing. This size limitation is geometrically limited by the gas lift valve's requisite small size, and the position of its operating mechanism, which prevents a full bore through the valve for maximum flow.

Other prior art gas lift valves employ pressure responsive adjustable flow valves that automatically or manually adjust the gas flow rate through the gas lift valve to attempt to maintain a certain pressure condition within the well bore and the gas lift valve. Other gas lift valves may further employ hydraulic, electric, and electric-hydraulic actuators either integral to or separate or even detachable from the gas lift valve to remotely actuate the valve and to control the extent to which the valve is opened or closed. Co-pending U.S. application Ser. No. 08/912,150 discloses several embodiments of separate or detachable actuators, or power units, responsive to hydraulic pressure to control the size of the opening of the variable orifice valve of gas lift valves and is incorporated by reference herein the same as if set forth fully herein except to the extent the teachings are consistent.

A number of existing variable orifice adjustable gas lift valves require maintenance and balance of hydraulic pressure within the gas lift valve or valve actuator to maintain a particular flow setting of the gas lift valve orifice. Position holders have been utilized, which attempt to maintain the position of the actuator relative to the gas lift valve to attempt to mechanically assure that the setting of the gas lift valve orifice remains in the position set by the operator if conditions in the hydraulic system change slightly in use. However, such prior position holders were not designed to securely hold the gas lift valve orifice in a set position without the continued supply of hydraulic pressure.

U.S. Pat. No. 5,535,767 discloses a remotely actuated adjustable choke valve having a rotatably adjustable cam and follower arrangement axially disposed within the valve body to selectively govern the relative axial position of the valve stem of the choke valve with respect to the valve body. However, the placement of the cam and follower within the valve body may be undesirable in certain applications, for example, where increased flow through the valve body is desired. Moreover, the hydraulic actuation system used to actuate the cam and follower to select the axial position of the valve stem within the valve body is also provided within the valve body, which can provide an undesirably complex valve system and also further decrease the flow rate available through the choke valve.

Because well conditions and gas lift requirements change over time, those skilled in the art of well operations are also constantly aware of the compromise of well efficiency that must be balanced versus the cost of intervention to install the most optimal gas lift valves therein as well conditions change over time. Well intervention is expensive, most especially on prolific offshore or subsea wells, so a valve that can be utilized over the entire life of the well, and whose orifice size and subsequent flow rate can be adjusted to changing downhole conditions, is a long felt and unresolved need in the oil industry. There is also a need for a novel gas lift valve that has a gas injection orifice that is large enough to inject a volume of gas adequate to lift oil in large diameter production tubing. There is also a need for differing and novel operating mechanisms for gas lift valves that will not impede the flow of injection gas therethrough and that can be remotely set using a power source without the need for a continued supply of power to maintain the desired setting of the gas lift valve orifice.

SUMMARY OF THE INVENTION

The present invention has been contemplated to overcome the foregoing deficiencies and meet the above described needs. In one aspect, the present invention is a gas lift assembly for use in a subterranean well, comprising: a gas lift mandrel having first and second bores; a valve body with a longitudinal bore therethrough for sealable insertion in the first bore of the mandrel; a variable orifice valve in the valve body for controlling fluid flow through the body; and an actuating assembly provided separate from and connected to the variable orifice valve. Another feature of this aspect of the present invention is that the actuating assembly may further include a mechanical position holder and the mechanical position holder may comprise an indexable cam and follower arrangement.

Another feature of this aspect of the present invention is that the indexable cam and follower arrangement may include a cylindrical cam having a plurality of axial slots formed around the periphery thereof, each of the axial slots having different lengths. Yet another feature of this aspect of the invention is that the different lengths of the axial slots may correspond to different variable orifice valve positions. Another feature of this aspect of the invention is that the actuating assembly may be hydraulically operated, and may further include: a hydraulic actuating piston located in the actuating assembly and operatively connected to the variable orifice valve; a spring, biasing the variable orifice valve in a full closed position; and at least one control line connected to the hydraulic actuating piston and extending to a hydraulic pressure source.

Another feature of this aspect of the present invention is that either the valve body or the actuating assembly may be retrievably locatable within a side pocket mandrel by wireline and coiled tubing intervention tools. Further, either the gas lift valve or the actuating assembly may be selectively installed and retrievably detached from the actuating assembly.

In another aspect, the present invention may be an actuating assembly for selectively setting the operating position of a variable orifice gas valve the gas valve having a valve stem and being positioned within a valve body, the actuating assembly comprising: an actuating assembly housing; an axially moveable piston disposed within the housing and operably connected to the orifice gas valve; an actuating device for selectively moving the moveable piston within the housing; and a mechanical position holder to retain the moveable piston in a desired operating position. A feature of this aspect of the invention is that the actuating device may comprise: a device for biasing the moveable piston to a first position; a hydraulic actuating chamber operably connected to the moveable piston; and a source of fluid pressure in fluid communication with the hydraulic actuating chamber for introduction of fluid pressure within the hydraulic actuating chamber to move the moveable piston to a second position, thereby moving the valve stem to a desired operating position within the valve body. Further, the mechanical position holder may be a rotatable cylindrical cam having: a plurality of axial slots disposed there around, each of the axial slots may have an intermediate slot connecting the axial slot to its neighboring axial slot; and the axial and intermediate slots may be adapted to receive a portion of an axially fixed follower engaged therein, whereby the follower will support the cylindrical cam and retain the moveable piston in a desired operating position. Another feature of this aspect of the present invention is that the cylindrical cam may be rotatably indexed so that the follower travels within the intermediate slot to be engaged within a neighboring axial slot.

In another aspect, the present invention may be a gas lift valve assembly for use in a subterranean well, comprising: an elongated valve body having an injection gas port and a gas delivery port; an elongated valve stem disposed within said valve body for axial displacement relative thereto to adjust a rate of injection gas flow between the injection gas port and said gas delivery port as a function of a relative axial position of said valve stem with respect to said valve body; a cam disposed without said valve body and operably connected to the valve stem; said cam providing a plurality of axial displacement positions thereon to place said valve stem at a selected one of a plurality of relative axial positions with respect to said valve body; said cam operably connected to an actuating piston responsive to fluid pressure to reciprocate said actuating piston between cocked and set positions; said cam moving from a first axial displacement position to a second axial displacement position as said actuating piston is reciprocated, a difference between said first and second axial displacement positions thereby causing an adjustment of said rate of injection gas flow between said injection gas port and said gas delivery port. Another feature of this aspect of the present invention is that the cam and actuating piston may be disposed axially within an actuating housing separated from and detachably connected to the valve body.

BRIEF DESCRIPTION OF THE DRAWINGS

FIG. 4A is an elevation view of the gas lift valve assembly of the present invention shown in a fully closed position.

FIG. 4B is a perspective view of a cylindrical cam embodiment of the position holder of the present invention, showing an axial slot corresponding to a closed cam position and also partially showing a preceding axial slot corresponding to a partially open cam position and partially showing a successive axial slot corresponding to a fully open cam position.

FIG. 5A is an elevation view of the gas lift valve assembly of the present invention shown in a fully open position.

FIG. 5B is a perspective view of a cylindrical cam embodiment of the position holder of the present invention, showing an axial slot corresponding to a fully open cam position and also partially showing a preceding axial slot corresponding to a closed cam position and partially showing a successive axial slot corresponding to a partially open cam position.

Figure 1A:
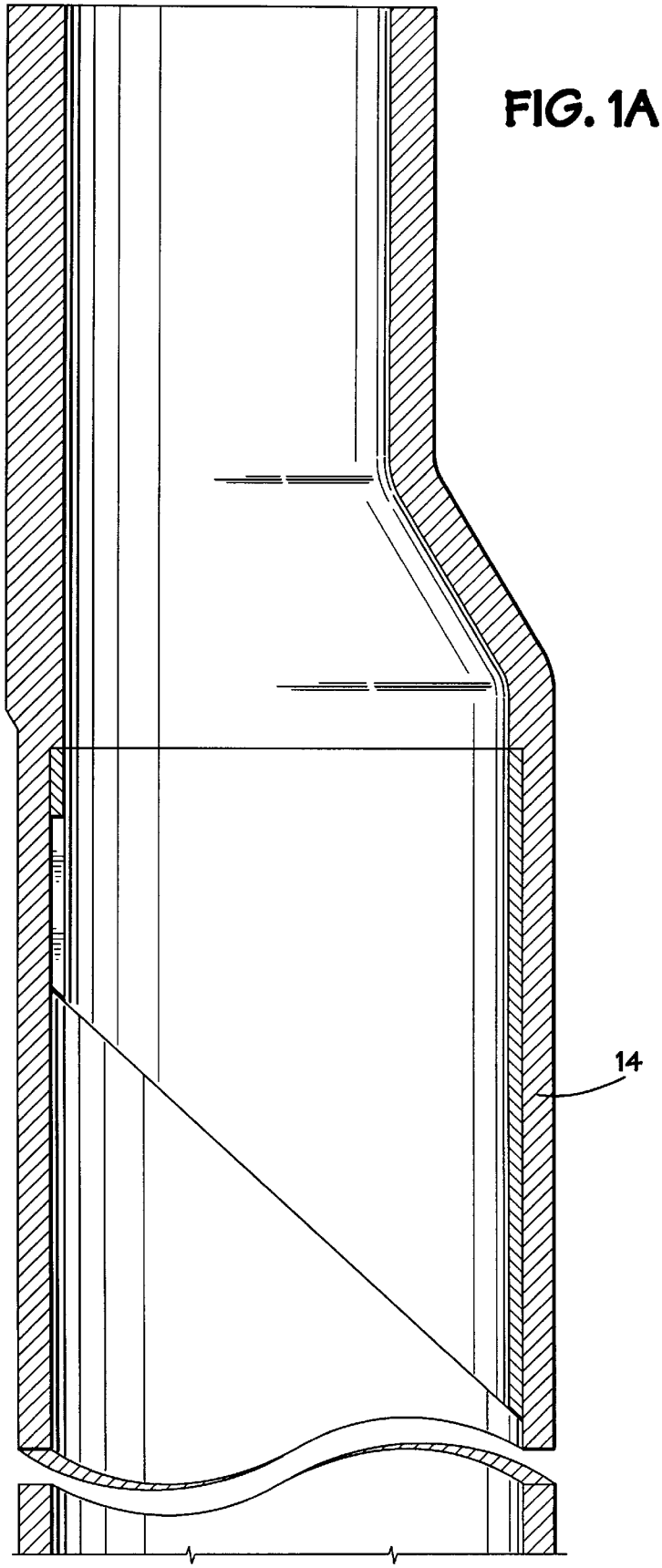
FIGS. 1A–1C are elevation views which together illustrate a hydraulically operated embodiment of the apparatus of the present invention connected to a single hydraulic control line running from the earth's surface; the power unit is shown rotated ninety degrees for clarity.

While the invention will be described in connection with the preferred embodiments, it will be understood that it is not intended to limit the invention to those embodiments. On the contrary, it is intended to cover all alternatives, modifications, and equivalents as may be included within the spirit and scope of the invention as defined by the appended claims.

DESCRIPTION OF THE PREFERRED EMBODIMENTS

In the description that follows, like parts are marked through the specification and drawings with like reference numerals, respectively. The figures are not necessarily drawn to scale, and in some instances, have been exaggerated or simplified to clarify certain features of the invention. One skilled in the art will appreciate many differing applications of the described apparatus.

For the purposes of this discussion, the terms "upper" and "lower," "up hole" and "downhole," and "upwardly" and "downwardly" are relative terms to indicate position and direction of movement in easily recognized terms. Usually, these terms are relative to a line drawn from an upmost position at the surface to a point at the center of the earth, and would be appropriate for use in relatively straight, vertical wellbores. However, when the wellbore is highly deviated, such as from about 60 degrees from vertical, or horizontal, these terms do not make sense and therefore should not be taken as limitations. These terms are only used for ease of understanding as an indication of what the position or movement would be if taken within a vertical wellbore.

Figure 1B:
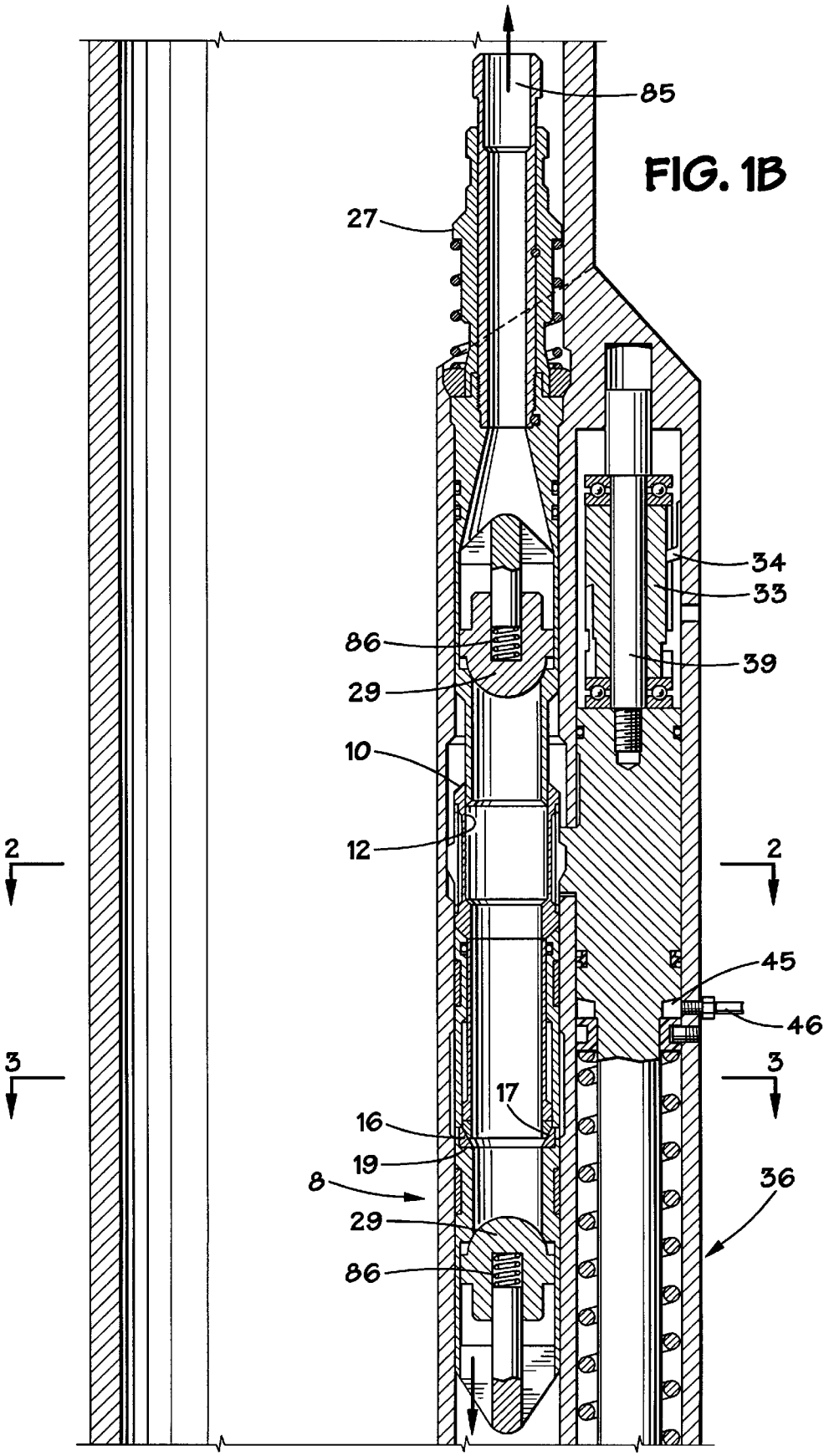
Figure 1C:
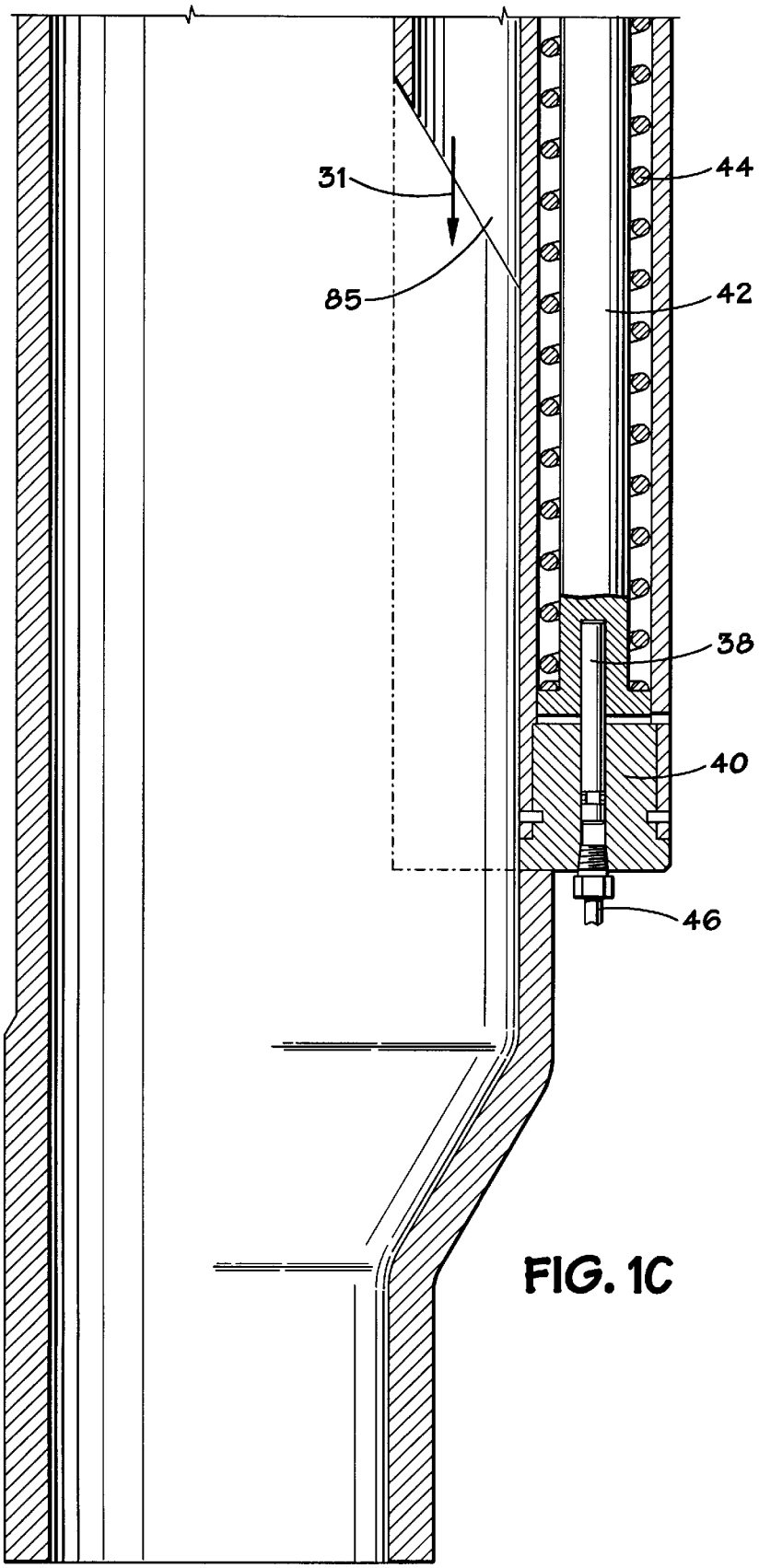
Figure 3:
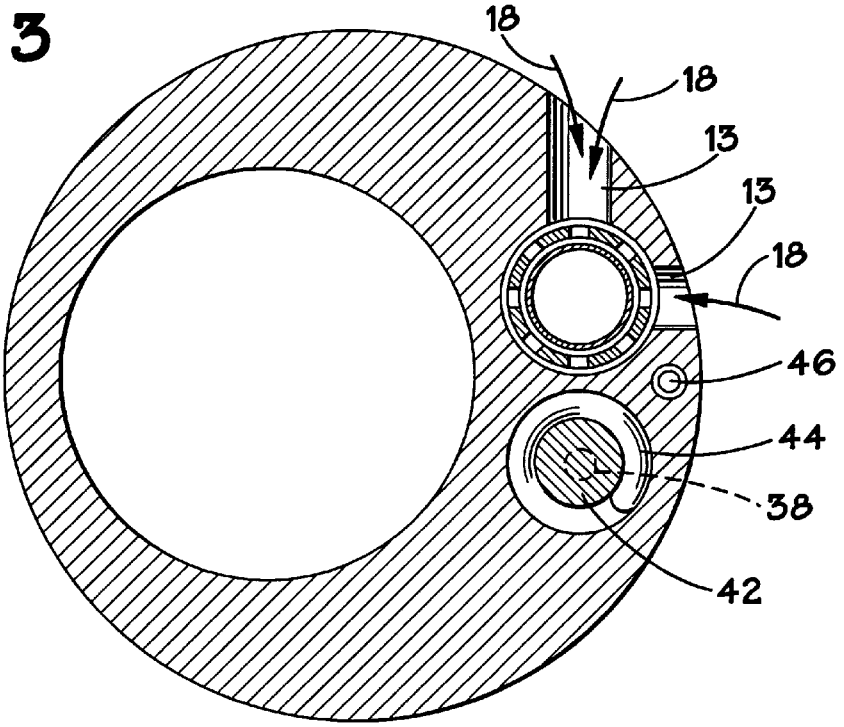
FIG. 3 is a cross-sectional view taken along line 3—3 of FIG. 2B.

FIGS. 1A–1C together depict a semidiagrammatic cross section of a gas lift valve assembly 8 shown in the closed position, used in a subterranean well (not shown), illustrating: a valve body 10 with a longitudinal bore 12 for sealable insertion in a side pocket mandrel 14, a variable orifice valve 16 in the body 10 which alternately permits, prohibits, or throttles fluid flow (represented by item 18—see FIG. 3) into said body through injection gas ports 13 in the mandrel 14 and out of said body into the well bore through a plurality of gas delivery ports 85, and an actuating means, or actuator assembly, shown generally by numeral 36 that is hydraulically operated. Further illustrated is: a lower hydraulic actuating piston 38 located in a downhole housing 40 and operatively connected to a moveable piston 42, which is operatively connected to the variable orifice valve 16 and upper hydraulic actuating piston 39. A spring 44, biases said moveable piston 42 and thereby biases said variable orifice valve 16 to the full closed position, and control lines 46 communicate with both the lower and upper hydraulic actuating pistons 38, 39, respectively, and extends to a hydraulic pressure source (not shown). When it is operationally desirable to open the variable orifice valve 16, hydraulic pressure is applied from the hydraulic pressure source (not shown), which communicates down the hydraulic control lines 46 to the upper and lower hydraulic actuating pistons 38, 39, respectively, thereby moving the moveable piston 42 uphole against the normal biasing force of spring 44, which opens the variable orifice valve 16 that is operatively connected thereto. The variable orifice valve 16 may be stopped at intermediate positions between fully open and fully closed to adjust the flow of lift or injection gas 31 therethrough, and is held in place by a position holder 33, which is configured as described further below to mechanically assure that the actuating assembly 36 remains in the desired position as set by the operator even if hydraulic pressure provided by hydraulic control lines 46 is not present in the hydraulic system. The orifice valve 16 is closed by indexing of the position holder 33 to a fully closed setting, which will allow the spring 44 to fully bias the moveable piston 42 and therefore the variable orifice valve 16 operably connected thereto back to the closed position.

Figure 2:
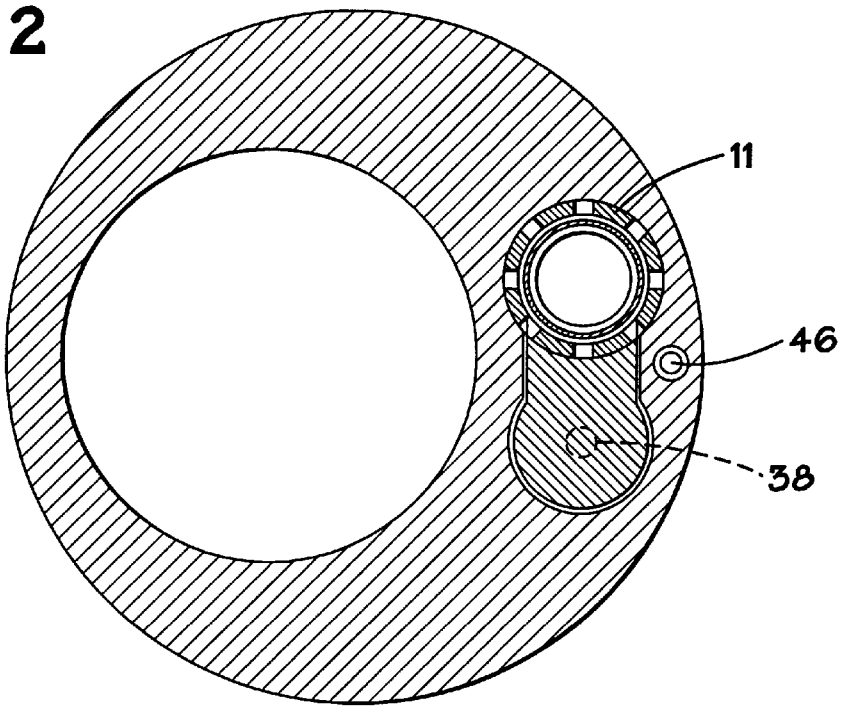
FIG. 2 is a cross-sectional view taken along line 2—2 of FIG. 2B.
Figure 6:
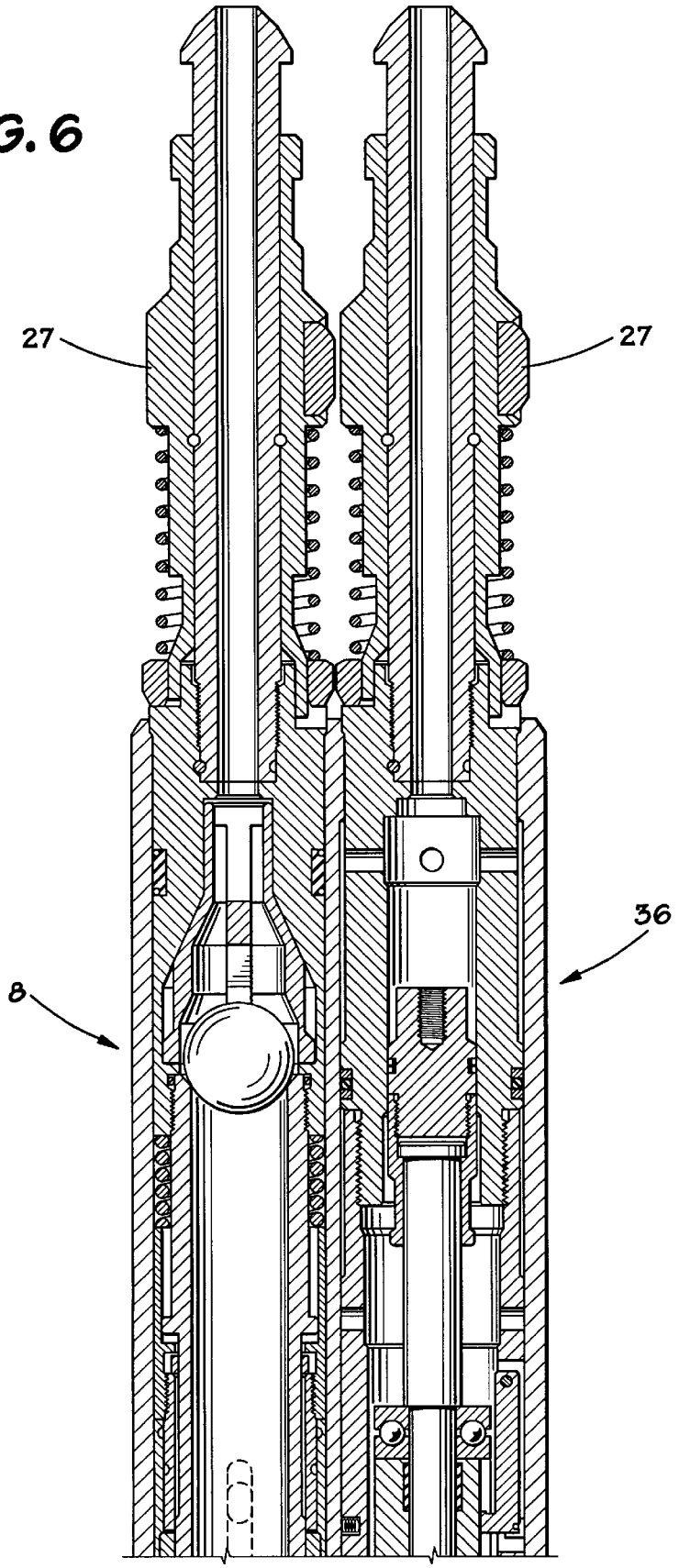
FIG. 6 is a partial elevation view of an actuator assembly and gas lift valve assembly each having a latch so the actuator assembly and gas lift assembly may each be discretely remotely installed and/or retrieved by well known wireline or coiled tubing intervention methods.

As shown in FIG. 1B, the variable orifice valve 16 may include a carbide stem 17 and seat 19 to effectively prevent gas flow through the gas lift valve assembly 8 into the well conduit when the variable orifice valve 16 is in the fully closed position. The gas lift valve 8 may also be provided with one-way check valves 29 to prevent any fluid flow from the well conduit into the gas lift valve 8. The gas lift valve 8 may also be provided with a latch 27 so the valve may be remotely installed and/or retrieved by well known wireline or coiled tubing intervention methods. As shown in FIG. 2, this embodiment of the present invention may also be provided with a valve connection collet 11, the structure and operation of which are well known to those of ordinary skill in the art. As shown in FIG. 6, the actuator assembly, or power unit 36 may also be provided with a latch 27 so the actuator assembly, or power unit 36 may be remotely installed and/or retrieved by well known wireline or coiled tubing intervention methods separate and discrete from the gas lift valve body 8. In an embodiment not shown, a position holder 33 may also be provided in the gas lift valve body 8 and operably connected to valve stem 17 to permit wireline or other removal of the actuator assembly 36 while permitting the orifice valve 16 to remain in a selected open position.

The position holder 33 of the present invention may preferably include a rotatable cylindrical sleeve member, or cylindrical cam 33, having first and second opposing ends. However, it should be noted that the position holder 33 need not be a cylindrical cam and follower arrangement and other cam arrangements can be readily perceived by one of ordinary skill in the art to function as a selectable and indexable variable position holder such as cylindrical cam 33. The cylindrical cam 33 is held in position around and affixed to upper actuating piston 39. The cylindrical cam 33 is affixed to the upper actuating piston 39, which is in turn affixed to moveable piston 42 so that axial movement of either the hydraulic actuating piston 38 or the moveable piston 42 will cause a corresponding axial movement of the cylindrical cam 33 within the actuator assembly 36.

As shown in FIGS. 4B, 5B, and 7A–7C, cylindrical cam 33 preferably includes a plurality of axial slots 60 of varying length disposed circumferentially around the cylindrical cam 33, which are each adapted to selectively receive a portion of follower 34 (FIG. 1B) provided at a fixed location on the actuator assembly 36. Because the moveable piston 42 is normally biased downward with respect to the follower 34, the follower 34 will normally be engaged within an upper portion of at least one of the axial slots 60 of the cylindrical cam 33, retaining cam 33 thereby supporting the cylindrical cam 33 and the moveable piston 42 affixed thereto and preventing downward movement of the moveable piston 42 beyond a distance determined by the length of the particular axial slot 60 in which the follower 34 is disposed. The particular axial slot 60 in which the follower 34 is disposed can be selected by the operator, as described further below. Therefore, by selecting an axial slot 60 having a desired length, the operator can select the desired resting position of the moveable piston 42 axially within the actuator assembly 36, which will select the desired orifice opening of the variable orifice valve 16, which is itself determined by the axial location of the moveable piston 42 within the actuator assembly 36.

Figure 7A:
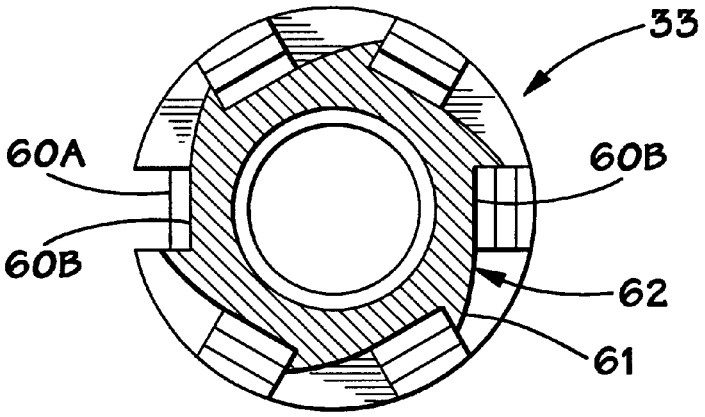
FIG. 7A is a cross-sectional view taken along line 7A—7A of FIG. 7B.
Figure 7B:
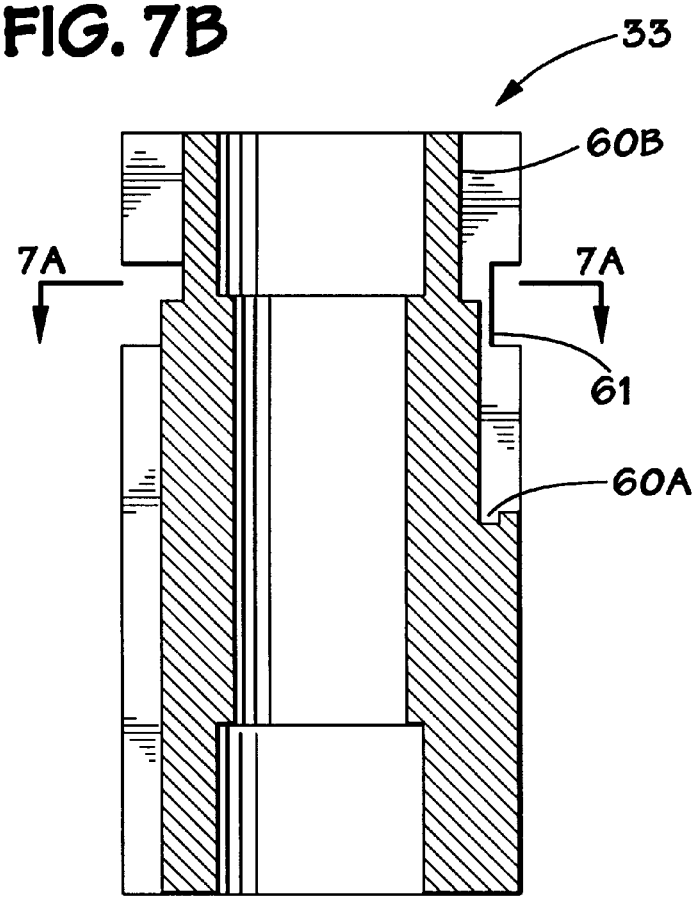
FIG. 7B is a partial cross-sectional view of the cylindrical cam embodiment of the position holder of the present invention.
Figure 7C:
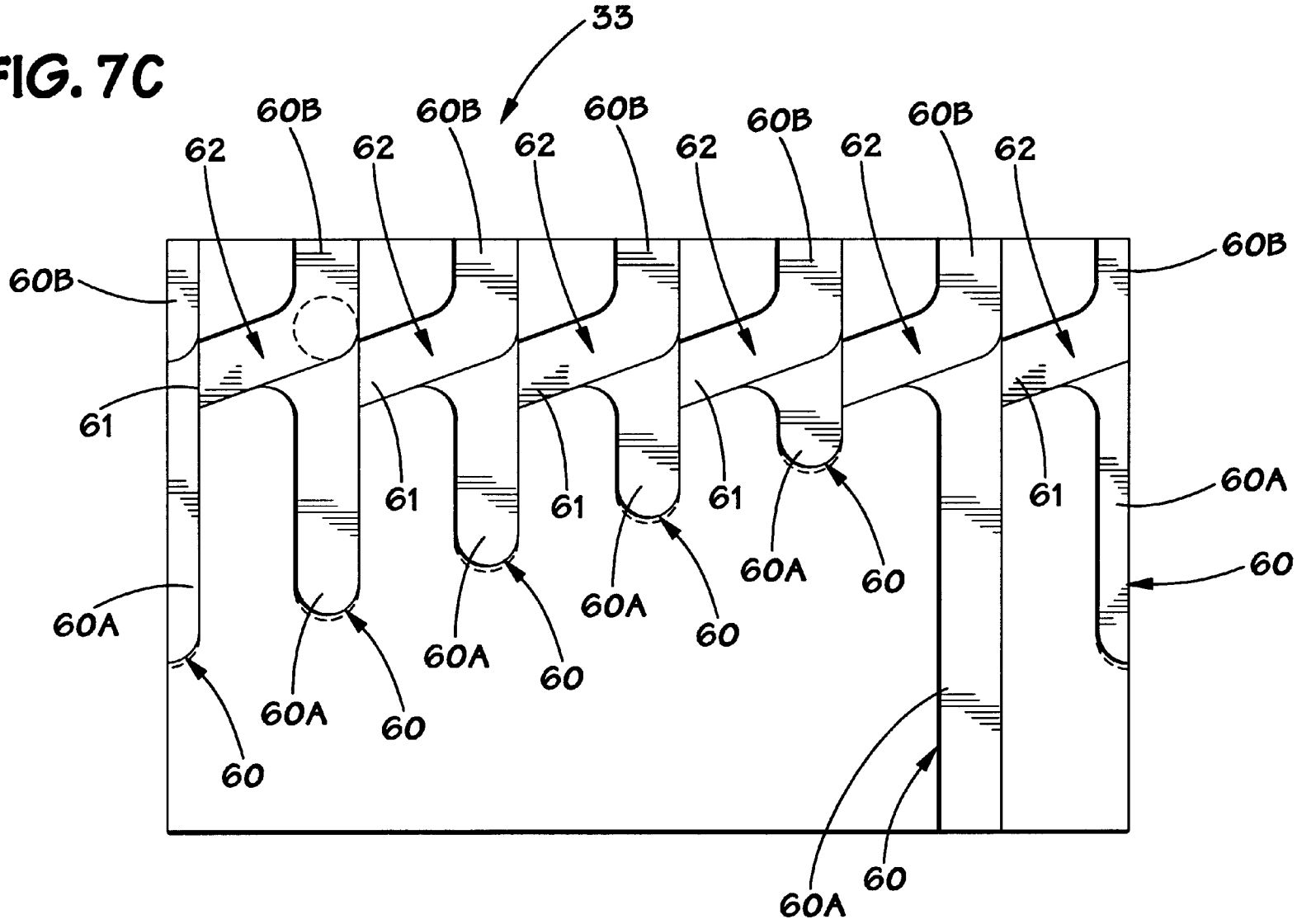
FIG. 7C is a planar projection of the outer cylindrical surface of the cylindrical cam embodiment of the position holder of the present invention.

A particular axial slot 60 having a desired length may be selected by an operator by momentarily providing hydraulic pressure through control lines 46 to either or both of hydraulic chamber 45 and hydraulic actuating piston 38, which will cause upward movement of the moveable piston 42 and upper and lower acting pistons 38, 39 within the actuator assembly 36. As previously described, upward movement of the moveable piston 42 will cause cylindrical cam 33 to also move upward axially within the actuator assembly 36 relative to the follower 34. A lower portion 60B of each of the axial slots 60 on cylindrical cam 33 has a smaller diameter than the upper portion 60A of axial slot 60 and is, thereby, recessed from the upper portion thereof as best illustrated in FIG. 7B. Therefore, as the cylindrical cam 33 is moved upward with respect to the follower 34, the follower 34 travels downward with respect to the cylindrical cam 33 and into the recessed lower portion 60B of the axial slot 60. The upper portion 60A of axial slot 60 is, itself, recessed from the upper portion 61 of tapered intermediate slot 62 connecting the upper portion 60A of axial slot 60 to the successive axial slot 60 immediately neighboring axial slot 60, which has a different length 1 from axial slot 60.

Follower 34 is biased against cylindrical cam 33 by a spring arrangement (not shown) so that on subsequent downward movement of the cylindrical cam 33 with respect to the follower 34 the follower 34 is prevented from returning directly to the upper portion of cylindrical cam 33 and, instead, is directed against an arcuate portion 63 of axial slot 60 separating the recessed lower portion 60B of axial slot 60 from the elevated upper portion 60A of axial slot 60. The bearing force of the follower 34 against the arcuate portion 63 on downward motion of the cylindrical cam 33 with respect to the follower 34 is then translated into rotatable motion of the cylindrical cam 33 with respect to the follower 34, which then continues to be engaged within a tapered intermediate slot 62 of cylindrical cam 33. Each axial slot 60 has an associated tapered intermediate slot 62, which connects that axial slot 60 with its immediately neighboring axial slot 62 having a different length.

The tapered intermediate slot 62 of cylindrical cam 33 is tapered from the recessed position of the lower portion 60B of axial slot 60 to an elevated position having a greater diameter than either the upper portion 60A or lower portion 60B of axial slot 60. The tapered intermediate slot 62 also has an arcuate path so that as the cam and follower movement translates the bearing force of the follower 34 against the arcuate portion 63 of axial slot 60, the follower 34 continues along the arcuate path of tapered intermediate slot 62, the upward force thereof then being translated along a wall of tapered intermediate slot 62 to continue the rotatable movement of cylindrical cam 33 with respect to the follower 34. The follower 34 is thereby moved along the arcuate path of tapered intermediate slot 62 toward the immediately neighboring axial slot 60 to select a new axial position of moveable piston 42. As the follower 34 enters the immediately neighboring axial slot 60, it drops into the recessed upper portion 60A of the immediately neighboring axial slot 60, which is recessed from the upper portion 61 of the tapered intermediate slot 62 of axial slot 60 so that follower 34 cannot immediately return along the arcuate path of the tapered intermediate slot 62 from which it had immediately traveled. Instead, follower 34 is permitted to travel only in one circumferential direction along cylindrical cam 33 and within the axial and intermediate slots, 60, 62 therein. The cylindrical cam 33 can thereby be selectively and successively indexed between each of the axial slots 60 to selectively choose the desired axial slot length 1 and, accordingly, the desired axial resting position of moveable piston 42 within actuator assembly 36.

The upward and downward movement of moveable piston 42 and the corresponding indexing of cylindrical cam 33 within the actuator assembly 36 may be provided by a combination of a continual compressive spring force acting against the moveable piston 42 to: (1) bias the moveable piston 42 and, consequently, to bias the variable orifice valve 16 toward a closed position; and (2) a momentary pressure force acting upward on moveable piston 42 and lower hydraulic actuating piston 38 to momentarily resist the biasing spring force and axially move the moveable piston 42 and the cylindrical cam 33 toward an open position to index the cylindrical cam 33 to a desired cam position to hold the variable orifice valve 16 in a desired position. Because the fluid pressure force is provided merely to index the cylindrical cam 33 to a desired cam position and because the follower 34 supports the moveable piston 42 in the desired operating position against the biasing force of spring 44, the hydraulic fluid pressure can be removed after indexing the cylindrical cam 33 to the desired cam position. It should be noted that either or both of the moveable piston 42 and the lower hydraulic actuating piston 38 can be provided with fluid pressure so that the pistons 42, 38 can act either together or independently to move the moveable piston 42 toward an open position and to select a desired cam position to hold the variable orifice valve 16 in a desired position.

By way of illustration, the operation of the gas lift valve 8 between the open and closed positions when the position holder 33 is in open and closed cam positions, respectively is shown in FIGS. 4A–5B. FIG. 4A shows the position of the variable orifice valve 16 and the operation of the one-way check valves 29 when the cylindrical cam 33 is indexed to a fully closed position. As shown in FIG. 4B, a slot 60 having slot length 1, sized sufficient to permit full downward travel of the valve stem 17, is selected to close the variable orifice valve 16 to a fully closed position. Injection gas 18 is provided through injection gas port 13 and is prevented from delivery through gas delivery ports 85 by seals 15 and the sealing engagement between valve stem 17 and valve seat 19. Wellbore fluid is prevented from entering the gas valve body 8 by one-way check valves 29 held into sealing engagement with the valve body 8 by springs 86. As shown in FIG. 5B, a slot 60 having slot length l, sized sufficient to permit full downward travel of the valve stem 17, is selected to permit the variable orifice valve 16 to open to an open position. Injection gas 18 is provided through injection gas port 13 and is delivered through gas delivery ports 85 as valve stem 17 is moved upward from sealing engagement with valve seat 19. Wellbore fluid is prevented from entering the gas valve body 8 by the fluid pressure of injection gas 18. The injection gas 18 is allowed to flow through one-way check valves 29 because the pressure force of the injection gas 18 is sufficient to overcome both the spring force of spring 86 and the hydraulic pressure of the well bore fluid acting against the one-way check valves 29, thus opening one-way check valves 29 to permit the injection gas to flow through gas delivery ports 85 and into the well bore.

It should be noted that the preferred embodiments described herein employ a well known valve mechanism generically known as a poppet valve to those skilled in the art of valve mechanics. It can, however, be appreciated that several well known valve mechanisms may obviously be employed and still be within the scope and spirit of the present invention. Rotating balls or plugs, butterfly valves, rising stem gates, and flappers are several other generic valve mechanisms which may obviously be employed to accomplish the same function in the same manner. Further, in the embodiment in which a position holder may be provided in the gas lift valve body, the axial and intermediate slot arrangement of the cylindrical cam may be provided in an outer wall of the valve stem with a follower or lug adapted to engage within the slots of the valve stem to provide a position holder within the valve body without unnecessarily restricting the fluid flow within the valve body and maintaining a dual gas discharge ports located at opposing ends of the valve body.

Whereas the present invention has been described in particular relation to the drawings attached hereto, it should be understood that other and further modifications, apart from those shown or suggested herein, may be made within the scope and spirit of the present invention. Accordingly, the invention is therefore to be limited only by the scope of the appended claims.

What is claimed is:

1. A gas lift assembly for use in a subterranean well, comprising:

a gas lift mandrel having first and second bores;

a valve body with a longitudinal bore therethrough for sealable insertion in the first bore of the mandrel;

a variable orifice valve in the valve body for controlling fluid flow through the body; and an actuating assembly removably disposed within the second bore of the mandrel, and provided separate from and adapted to be connected to the variable orifice valve.

2. The gas lift assembly of claim 1, wherein the actuating assembly further includes a mechanical position holder.

3. The gas lift assembly of claim 2, wherein the mechanical position holder comprises an indexable cam and follower arrangement.

4. The gas lift assembly of claim 3, wherein the indexable cam and follower arrangement includes a cylindrical cam having a plurality of axial slots formed around the periphery thereof, each of the axial slots having different lengths.

5. The gas lift assembly of claim 4, wherein the different lengths of the axial slots correspond to different variable orifice valve positions.

6. The gas lift valve of claim 1, wherein the actuating assembly is hydraulically operated, further including:

a hydraulic actuating piston located in the actuating assembly and operatively connected to the variable orifice valve;

a spring, biasing the variable orifice valve in a full closed position; and at least one control line connected to the hydraulic actuating piston and extending to a hydraulic pressure source.

7. The gas lift valve of claim 1, wherein the valve body is retrievably locatable within a side pocket mandrel by wireline and coiled tubing intervention tools.

8. The gas lift valve of claim 7, wherein the gas lift valve is selectively installed and retrievably detached from the actuating assembly.

9. The gas lift valve of claim 1, wherein the actuating assembly is retrievably locatable within a side pocket mandrel by wireline and coiled tubing intervention tools.

10. The gas lift valve of claim 8, wherein the actuating assembly is selectively installed and retrievably detached from the valve body.

11. An actuating assembly for selectively setting the operating position of a variable orifice gas valve, the gas valve having a valve stem and being positioned within a valve body, the actuating assembly comprising:

an actuating assembly housing provided separate and laterally offset from and adapted to be connected to the valve body;

an axially moveable piston disposed within the housing and operably connected to the orifice gas valve;

an actuating device for selectively moving the moveable piston within the housing; and a mechanical position holder to retain the moveable piston in a desired operating position.

12. The actuating assembly of claim 11, wherein the actuating device comprises:

a device for biasing the moveable piston to a first position;

a hydraulic actuating chamber operably connected to the moveable piston; and a source of fluid pressure in fluid communication with the hydraulic actuating chamber for introduction of fluid pressure within the hydraulic actuating chamber to move the moveable piston to a second position, thereby moving the valve stem to a desired operating position within the valve body.

13. The actuating assembly of claim 11, wherein the mechanical position holder is a rotatable cylindrical cam having:

a plurality of axial slots disposed there around, each of the axial slots having an intermediate slot connecting the axial slot to its neighboring axial slot;

the axial and intermediate slots being adapted to receive a portion of an axially fixed follower engaged therein, whereby the follower will support the cylindrical cam and retain the moveable piston in a desired operating position.

14. The actuating assembly of claim 13, wherein the cylindrical cam may be rotatably indexed so that the follower travels within the intermediate slot to be engaged within a neighboring axial slot.

15. A gas lift valve assembly for use in a subterranean well, comprising:

an elongated valve body having an injection gas port and a gas delivery port;

an elongated valve stem disposed within said valve body for axial displacement relative thereto to adjust a rate of injection gas flow between the injection gas port and said gas delivery port as a function of a relative axial position of said valve stem with respect to said valve body;

a cam disposed without and laterally offset from said valve body and operably connected to the valve stem;

said cam providing a plurality of axial displacement positions thereon to place said valve stem at a selected one of a plurality of relative axial positions with respect to said valve body;

said cam operably connected to an actuating piston responsive to fluid pressure to reciprocate said actuating piston between cocked and set positions;

said cam moving from a first axial displacement position to a second axial displacement position as said actuating piston is reciprocated, a difference between said first and second axial displacement positions thereby causing an adjustment of said rate of injection gas flow between said injection gas port and said gas delivery port.

16. The gas lift valve assembly of claim 15, wherein the cam and actuating piston are disposed axially within an actuating housing separated from and detachably connected to the valve body.

* * * * *